US007229152B2

(12) United States Patent
Lassar et al.

(10) Patent No.: US 7,229,152 B2
(45) Date of Patent: Jun. 12, 2007

(54) FLUID EJECTION DEVICE WITH INSULATING FEATURE

(75) Inventors: Noah C. Lassar, San Diego, CA (US); Steven W. Steinfield, San Diego, CA (US); Joseph E. Scheffelin, Poway, CA (US); M. Jeffery Igelman, Corvallis, OR (US); Frank J. Breti, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 168 days.

(21) Appl. No.: 10/699,184

(22) Filed: Oct. 31, 2003

(65) Prior Publication Data

US 2005/0093927 A1 May 5, 2005

(51) Int. Cl.
*B41J 2/14* (2006.01)
*B41J 2/05* (2006.01)

(52) U.S. Cl. ..... 347/50; 347/58

(58) Field of Classification Search ..... 347/50, 347/58

See application file for complete search history.

(56) References Cited

U.S. PATENT DOCUMENTS 5,160,945 A * 11/1992 Drake ..... 347/42
5,278,584 A * 1/1994 Keefe et al. ..... 347/63
5,422,667 A * 6/1995 Daggs et al. ..... 347/87
6,394,580 B1 * 5/2002 Scheffelin et al. ..... 347/50
6,402,299 B1 6/2002 DeMeerleer et al.
6,428,145 B1 * 8/2002 Feinn et al. ..... 347/50
2002/0093550 A1 7/2002 Watanabe
2002/0123765 A1 9/2002 Sepetka et al.
2002/0157856 A1 10/2002 Pan
2003/0050663 A1 3/2003 Khachin et al.

FOREIGN PATENT DOCUMENTS

| | | |
|---|---|---|
| EP | 1277583 | 1/2003 |
| JP | 61141165 | 6/1986 |
| JP | 62043159 | 2/1987 |
| JP | 62163352 | 7/1987 |
| WO | WO 98/36694 | 8/1998 |
| WO | PCT/US2004/034640 | 10/2004 |

OTHER PUBLICATIONS

Search Report.

* cited by examiner

*Primary Examiner*—An H. Do

(57) ABSTRACT

In one embodiment, a fluid ejection device is configured to receive a signal and ejecting fluid in response thereto, including an ink ejecting nozzle layer having a substrate with first and second surfaces joined along an edge, an insulating feature located on the first surface adjacent the edge and a flexible lead that bends around the edge and lies flush against the insulating feature.

36 Claims, 7 Drawing Sheets

FLUID EJECTION DEVICE WITH INSULATING FEATURE

BACKGROUND

Fluid ejection devices, such as those based on piezo-electric or thermal technologies, typically have a firing element which activates in response to a firing signal to emit a small droplet of fluid from a firing chamber through a nozzle. The firing elements, firing chambers and nozzles may be constructed as a die using various photo-etching ("photolithography") techniques, such as those used to construct integrated circuits.

The firing signals are typically received from a controller which is electrically coupled to the firing elements by electrical conductors, often including flexible leads which are coupled to the die. Earlier systems of routing and protecting these leads over a side edge of the die resulted in the flexible leads projecting well above the exit surface of the nozzles, disadvantageously increasing the distance from the nozzle to the target surface which received the fluid droplets.

This increased nozzle-to-target distance decreases the trajectory accuracy, so the droplets are less likely to land where intended. If the fluid ejection device is used for depositing drops of ink onto a medium to print an image, the quality of the resulting printed image can be degraded as the trajectory accuracy is decreased. For these and other reasons, there is a need for the present invention.

SUMMARY

In one embodiment, a fluid ejection device is configured to receive a signal and ejecting fluid in response thereto, including an ink ejecting nozzle layer having a substrate with first and second surfaces joined along an edge, an insulating feature located on the first surface adjacent the edge and a flexible lead that bends around the edge and lies flush against the insulating feature.

BRIEF DESCRIPTION OF THE DRAWINGS

FIGS. 4A–4E show different enlarged embodiments of low profile conductors, shown as various embodiments of flexible leads used to couple the controller to the various embodiments of the device of FIG. 2A, with:

FIG. 4A being a perspective view of one embodiment;

FIG. 4B being a perspective view of another embodiment;

FIG. 4C being a perspective view of another embodiment;

FIG. 4D being a perspective view of another embodiment; and

FIG. 4E being a side elevational view of a lead according to the embodiments of FIGS. 4A–4D attached to a substrate.

DETAILED DESCRIPTION OF THE PREFERRED EMBODIMENTS

In the following description of the invention, reference is made to the accompanying drawings, which form a part hereof, and in which is shown by way of illustration specific examples in which the invention may be practiced. It is to be understood that other embodiments may be utilized and structural changes may be made without departing from the scope of the present invention.

Figure 1:
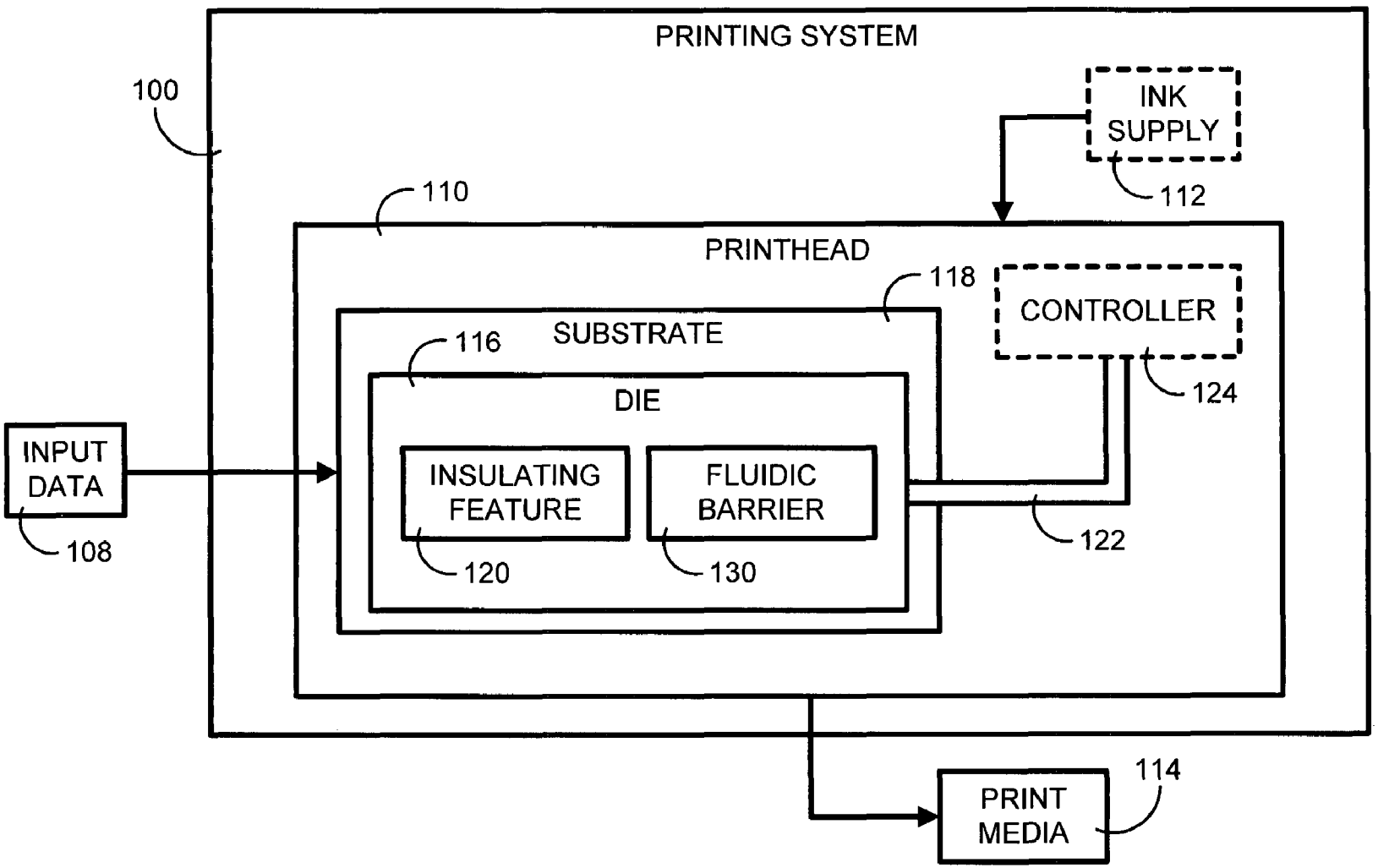
FIG. 1 is a block diagram of one embodiment of a fluid ejection system, shown as a printing system with a controller capable of providing firing signals to the various embodiments of the present invention.

FIG. 1 shows a block diagram of one embodiment of a fluid ejection system illustrated as a printing system 100. The printing system ejects fluid, such as printing colorant ("ink"), in response to input data 108, which may be received from an external source, such as a personal computer in the printing environment. A fluid ejection device, such as a printhead 110 is configured to receive ink from an ink supply 112 (shown in dashed lines because it may be either integrated with the printhead 110 or located elsewhere in printing system 100). A fluid target, such as print media 114, receives ink ejected from the printhead. The printhead 110 includes a die 116 which is located on a substrate 118, with the die 116 incorporating an insulating feature 120. Electrical conductors 122 couple the die to a controller 124 (shown in dotted lines because it may be either integrated with the printhead 110 or located elsewhere in printing system 100). The conductors 122 forward electrical commands from controller 124 to firing elements, such as piezo-electric elements, or electrical resistive elements in a thermal fluid ejection technology, as described in greater detail below with respect to FIG. 3.

Figure 2A:
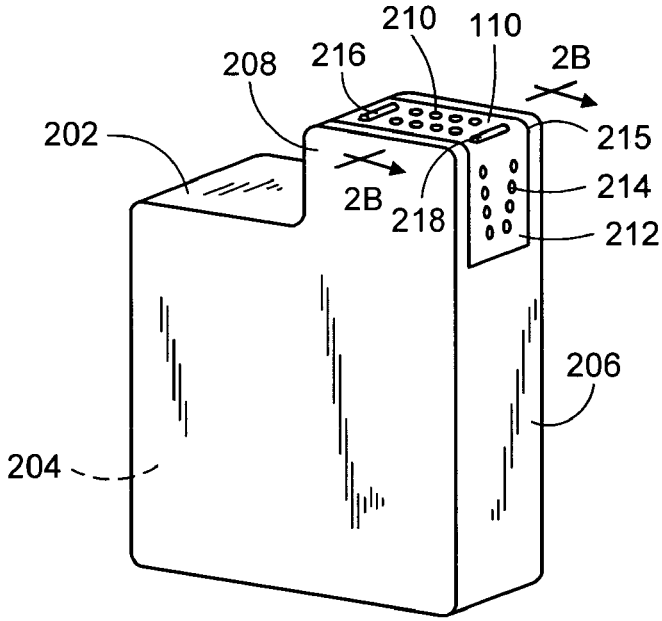
FIG. 2A is a perspective view of one embodiment of a fluid ejection device with low profile conductors, shown as an inkjet cartridge, which may be used in the printing system of FIG. 1.

FIG. 2A shows one embodiment of a fluid ejection device illustrated as an inkjet print cartridge 200. One embodiment of cartridge 200 has a body 202 which includes opposing first and second portions, with the first portion defining an ink reservoir 204 (depicted by a dashed lead line because the ink reservoir 204 is located within the body 202) therein and a side surface 206, while the second portion defines a printhead snout 208. Snout 208 supports printhead 110, which defines a series of ink ejecting nozzles 210, a few of which are schematically illustrated in FIG. 2A as being arranged in two substantially linear nozzle arrays.

The cartridge side surface 206 supports a cartridge interconnect, shown as a flex circuit 212 having a series of electromechanical interconnect contacts 214 which form a portion of conductors 122 leading to/from controller 124 when installed in system 100. In some embodiments the printhead 110 may also include one or more encapsulant beads, such as beads 216 and 218 located to each end of the arrays of nozzles 210. The encapsulant beads 216, 218 serve to protect electrical conductors associated with the nozzles from physical damage and from ink contamination, which may cause electrical shorting of current carrying conductors of the printhead.

Figure 2B:
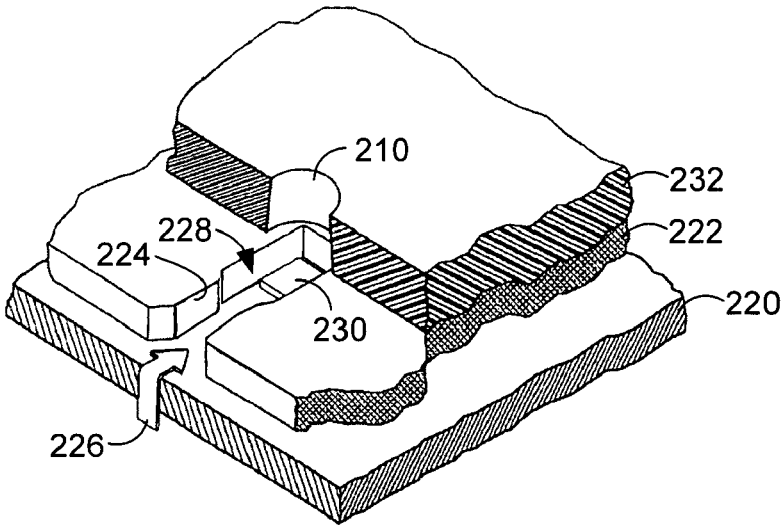
FIG. 2B is an enlarged, perspective view of a firing element, firing chamber, and nozzle of a fluid ejection device, taken along a portion of line 2B—2B of FIG. 2A.

FIG. 2B shows an enlarged sectional view of one half of one of the nozzles located along line 2B—2B in FIG. 2A, as used in one embodiment of an underlying printhead structure. Built on a substrate 220, typically of silicon or other semiconductor, is a primer layer 222 of an electrically insulating material, also known as a barrier layer or a passivation layer. The primer layer 222 defines a fluid feed channel 224 that delivers ink as illustrated by arrow 226 to a firing chamber 228, which is also defined by primer layer 222. Located within the firing chamber 228 is a firing element 230. Firing element 230 may be a firing resistor 230 in a thermal inkjet technology embodiment, although other firing elements in other technologies may be used, such as a piezo-electric firing element when employed in piezo-electric fluid ejection technology. Bondpads, as will be described subsequently in greater detail, are also typically disposed on substrate 220 in order to provide electrical connections to firing elements 230. A nozzle layer 232 overlays the primer layer 222 and defines nozzle 210, which is in fluid communication with the firing chamber 228.

In other embodiments, a die structure formed by primer layer 222 and nozzle layer 232 may be constructed of the same material, rather than the illustrated two-layer structure. Also, the various materials used to construct the printhead 110 are known to those of ordinary skill in the art, and other designs of fluid ejection heads may be substituted for the illustrated printhead 110, while still employing the inventive concepts described herein.

Figure 3A:
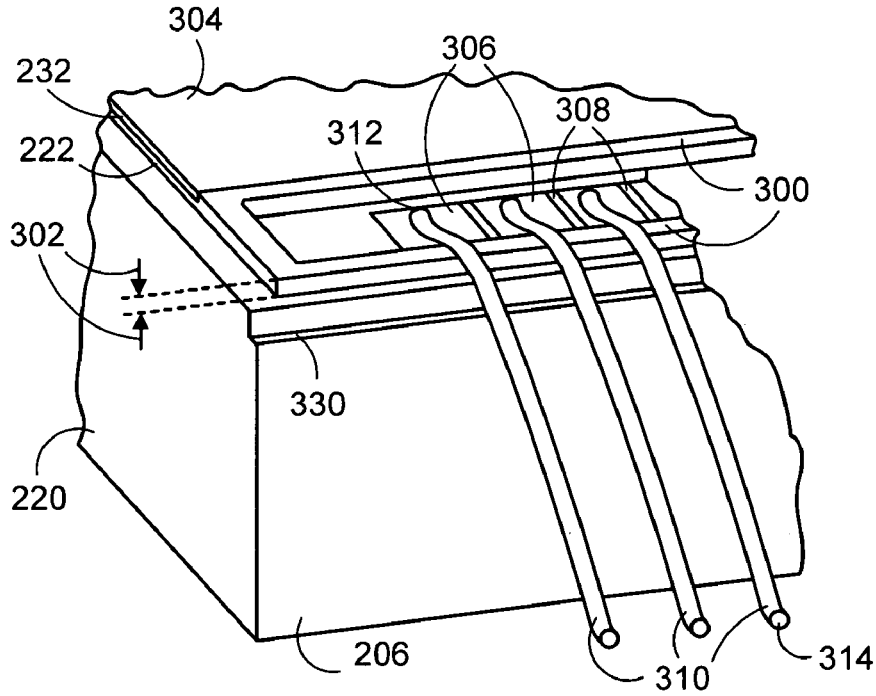
FIG. 3A is an enlarged, perspective view of a portion of one embodiment of a raised hedgerow insulating feature, suitable for use in the device of FIG. 2A.
Figure 3B:
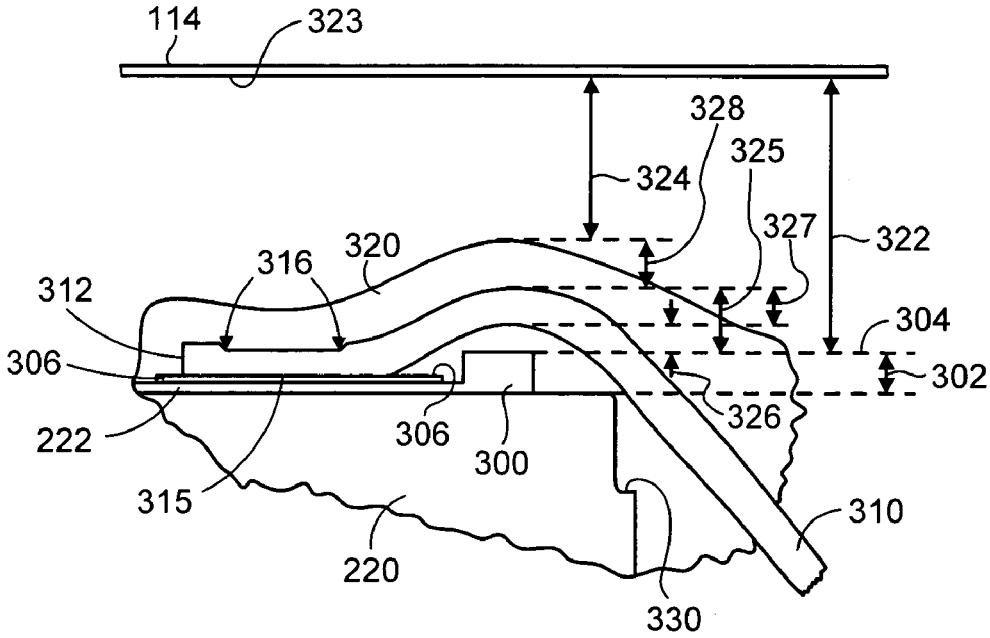
FIG. 3B is an enlarged, side elevational view of one lead of FIG. 3A attached to a substrate, showing the nozzle-to-target spacing (also referred to as "pen-to-paper spacing").

FIGS. 3A and 3B show one embodiment for a fluid ejection device using the two-layered printhead structure of FIG. 2B. The lower primer layer 222 defines a hedgerow 300 of an electrically insulative material having a height 302, indicated by a pair of opposing arrows, above substrate 220. Height 302 is the same height as nozzle exit surface 304 in some embodiments. Located within the hedgerow 300 are a group of bondpads 306, which are electrically isolated from one another by insulating strips 308. In this embodiment, the hedgerow 300 is raised and fully encompasses the region occupied by the bondpads 306 and insulating strips 308, although other configurations are also contemplated. The bondpads 306 and insulating strips 308 may be constructed during or after the printhead manufacturing process. In some embodiments, a round wire flexible lead 310 is electrically coupled to at least some of the bondpads 306 at a proximate end 312, while a distal end 314 of each lead drapes over a side surface 206' of the substrate 220, with surface 206' underlying the cartridge side surface 206.

FIG. 3B shows the contour of one lead 310, including an elongated contact area 315 and opposing indents or pinch points 316 near the proximate end 312, where the lead is pressed into place over the contact pad 306 to be electrically bonded thereto, for instance by soldering. Also shown in FIG. 3B is the contour of lead 310 as it exits over hedgerow 300. To protect the lead 310, an encapsulant bead 320 is applied over the lead, with bead 320 being in approximately the same location as bead 218 of FIG. 2B.

The nozzle exit surface 304 is indicated in dashed lines, and is the same height 302 as hedgerow 300, approximately 30–40 micrometers ("μm") above the substrate 220. A nozzle-to-target spacing 322 is defined between exit surface 304 and a target surface 323 of print media 114 in the illustrated printing system 100. To maintain trajectory accuracy of fluid ejected from nozzles 210 onto target surface 323, a small nozzle-to-target spacing 322 is used in one embodiment. Spacing 322 is chosen to maintain a minimum target-to-encapsulant spacing 324. FIG. 3B shows a nozzle-to-top-of-conductor or loop height 325 equal to the height of gap 326 between the bottom of the conductor and the top of the hedgerow 300 plus a diameter 327 of the conductor 310.

In this embodiment, pre-bent wires having a contour configured to match the hedgerow 300 are used so the minimum height is the sum of the hedgerow height 302, plus the diameter 327 of the round wire 310, which is approximately 30–32 μm, plus a height 328 of the encapsulant bead 320 over conductor 310. In the embodiment of FIGS. 3A and 3B, round wire leads 310 are first electrically bonded to bondpads 306, then bent over the hedgerow 300 without contacting the substrate 220 or a clean cut edge 330, described in greater detail below. The bent leads 310 maintain an electrical gap between the leads 310 and the sawn clean cut edge 330 to provide electrical isolation and prevent die edge electrical shorts. A die edge short is an electrical short between any one of leads 310 and the substrate 220.

FIGS. 4A–4D show several alternate embodiments of flexible leads which may be substituted for leads 310 to form four different embodiments of fluid ejection devices with low-profile conductors. In one embodiment, some of a base material is removed at selected locations along the leads to physically weaken the leads at the selected locations in order to facilitate bending of the leads at the selected locations. Enough base material is left in the selected locations to allow adequate current to flow through the leads without generating undue heat or resistance. In this manner, bending of the leads may be more precisely controlled.

Figure 4A:
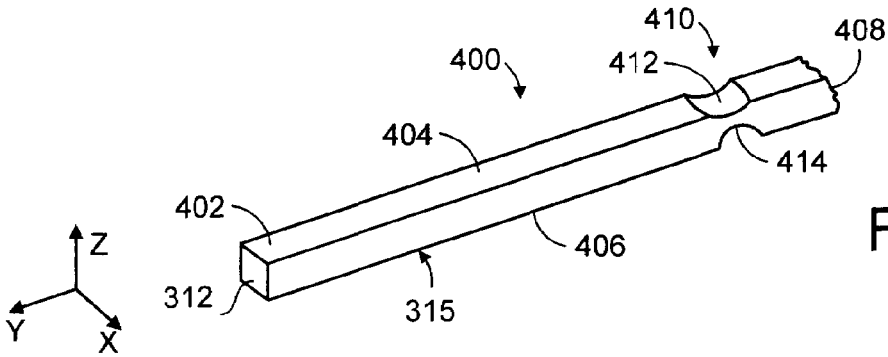

FIG. 4A shows a first embodiment of a weakened area flex lead 400, shown as a conductor 402 having a substantially rectangular cross-section with upper and lower opposing surfaces 404 and 406. Surfaces 404 and 406 lay in two substantially horizontal X-Y planes, with respect to the XYZ coordinate system, with the Z axis extending in a substantially vertical direction. The conductor 402 has a proximate end 312' which opposes a truncated distal end 408 (that is, shown truncated or fragmented in the figures), which will be electrically coupled to controller 124 when installed in the printing system 100. Between the proximate and distal ends 312', 408 are one or more vertically weakened areas 410 conductor 402 being notched out or crescent scooped out to define surfaces 412 and 414 located in the upper and lower surfaces 404 and 406, respectively. Thus, FIG. 4A illustrates a necking down or notching of lead 400 to create a thinner section in a Y-Z plane, as indicated with reference to the XYZ axes in the figures.

Figure 4B:
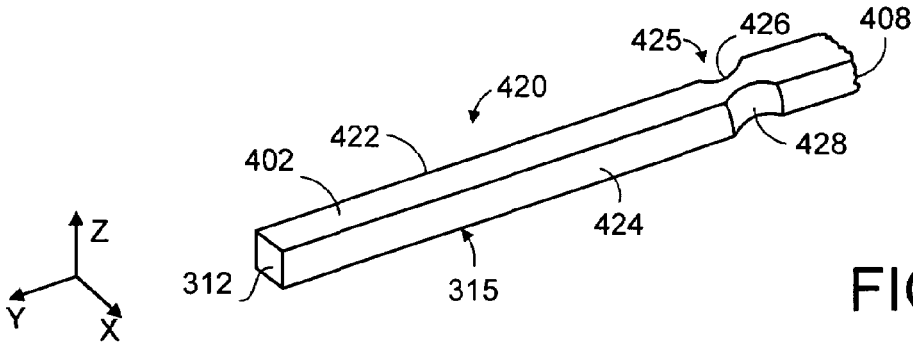

FIG. 4B shows a second embodiment of a weakened area flex lead 420, shown as a conductor 402' having a rectangular cross-section with opposing sides surfaces 422 and 424. The flex lead 420 has a horizontally weakened area 425, which may be defined by notched out or crescent scooped out surfaces 426 and 428 in side surfaces 422 and 424, respectively. While rectangular cross-section conductors are illustrated in FIGS. 4A–4E, other shapes of conductors may be more suitable in other implementations. Similarly, while crescent scooped surfaces 412, 414, 426 and 428 are shown to create the weakened areas 410 and 425, other methods may be used to create these weakened areas, for instance by pinching the conductors 402, 402' at the selected locations to reduce the amount of cross-sectional conductor material, which promotes controlled bending. Such pinching of the conductors may also be used with the round wire flexible leads 310 to reduce the cross-sectional area at a desired bending point. Thus, FIG. 4B illustrates a reduction in the thickness of lead 420 in an X-Y plane, which may be preferred in some implementations over the flex lead 400 embodiment due to the area moment of inertia ($=I=bh^3/12$, where h=thickness) of the rectangular flex lead.

Figure 4C:
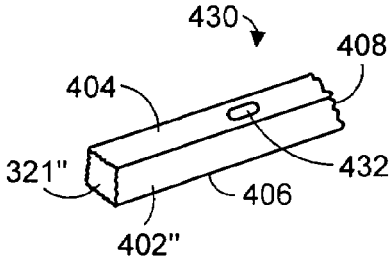

FIG. 4C shows a third embodiment of a weakened area flex lead 430 as being constructed of a conductor 402" having a rectangular cross-section. The conductor 402" has a weakened area formed by a void or hole 432 in the conductor, which may extend between upper and lower surfaces 404 and 406 in a selected location between a truncated proximate end 312" and the truncated distal end 408. In other embodiments, it may be preferable to have such a void or hole extending between sides surfaces of conductor 402".

Figure 4D:
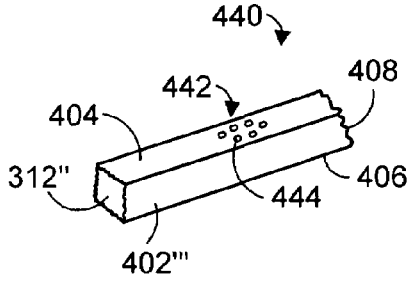

FIG. 4D shows a fourth embodiment of a weakened area flex lead 440 as being constructed of a conductor 402'" having a rectangular cross-section. Rather than the single void 432 of flex lead 430, conductor 402 has a weakened area 442 formed by plural holes, such as hole 444, extending between the conductor's upper and lower surfaces 404 and 406. As mentioned above with respect to FIGS. 4A and 4B, the conductors 402" and 402'" may be constructed of other shapes, rather than the rectangular cross-section illustrated. Similarly, while round holes 432, 444 are illustrated, other shapes of voids, such as slots, may be used to reduce the cross-sectional area of the conductors at the selected bend locations.

FIGS. 4C and 4D show the leads 430 and 440 as defining voids therethrough at the selected bend locations. While the illustrated voids or holes 432, 444 are described as being through holes, they may also go only partially through the respective conductors 402", 402'", or voids may extend partially through from one or more of the upper, lower or side surfaces.

Figure 4E:
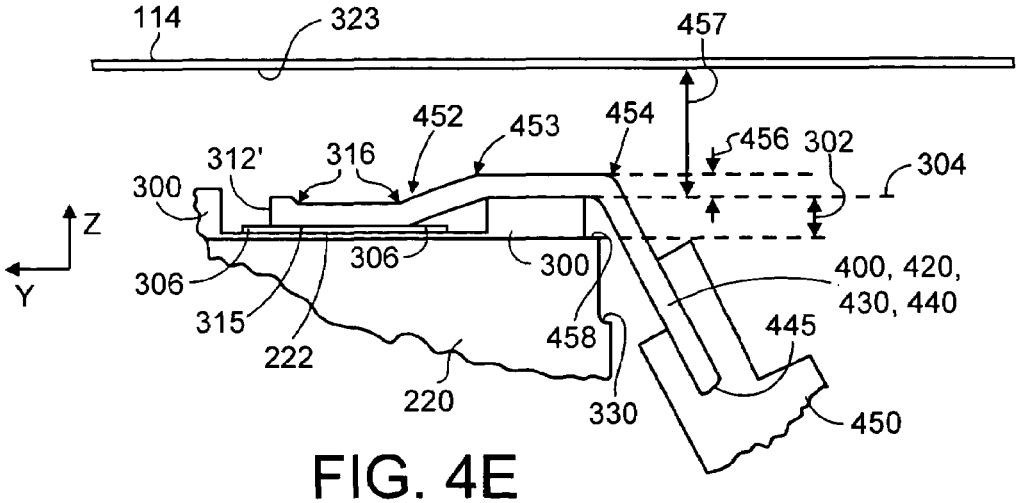

FIG. 4E illustrates the use of weakened area flex leads 400, 420, 430 or 440 having several selected bend locations to provide electrical connections to a fluid ejection device with hedgerow 300. Rather than the truncated distal end 408 shown in FIGS. 4A–4D, an actual distal end 445 is shown as being electrically coupled to a flex circuit 450, which may be substituted for flex circuit 212 of FIG. 2A. The distal end 445 of each conductor may be thermo-compression bonded to a conventional flex circuit electrical conductor (not shown) which terminates at one of the electromechanical interconnect contacts 214, forming a portion of the conductors 122 when installed in the printing system 100. The other flex leads illustrated herein may also be similarly connected to a flex circuit 450 as shown in FIG. 4E, or other suitable electrical coupling mechanisms known to the skilled in the art may be used instead.

A comparison of FIG. 4E with FIG. 3B shows a change in bend control, with flex leads 400, 420, 430, 440 each having three weakened areas 452, 453 and 454. These weakened areas cooperate so the leads directly overlay hedgerow 300 for a closer nozzle-to-top of conductor height 456 which allows the encapsulant bead (not shown) covering the structure to be lower and closer to the substrate 220, providing a closer nozzle-to-target spacing 457 than spacing 322 of FIG. 3B. The third weakened area 456 is located to bend the flex leads 400, 420, 430, 440 so the conductor 402, 402', 402", 402'" does not contact a die edge 458 or the clean cut edge 330, thereby avoiding die edge electrical shorts.

Several different embodiments have been discussed for producing a flex lead with a weakened area at a selected location to control bending of the lead into a predetermined contour. Other variations or combinations of the embodiments illustrated in FIGS. 4A–4D may be made to reduce the cross-sectional area at selected locations for bend points to provide a fluid ejection device with low profile conductors.

Figure 5:
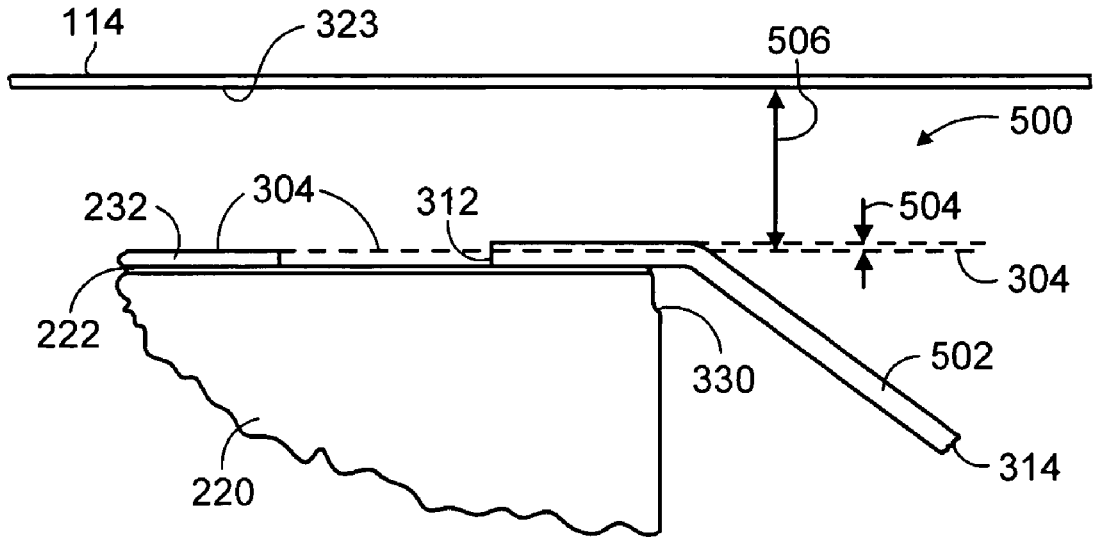
FIG. 5 is an enlarged, side elevational view of a portion of another embodiment of a fluid ejection device having a low profile conductor, suitable for use in the device of FIG. 2A.

FIG. 5 shows another alternate embodiment of a fluid ejection device with low-profile conductors formed as a two-layered, flattened hedgerow printhead structure 500. The flattened hedgerow structure 500 may be substituted for the printhead structure shown in FIGS. 3A and 3B and used in inkjet cartridge 200 or other fluid ejection device designs.

The flattened hedgerow structure 500 omits the raised hedgerow 300 of FIGS. 3A–3B, and instead continues the primer layer 222 at a minimal thickness, for instance on the order of 2 μm, and also extends the primer layer underneath wire conductors, such as wire conductor 502. Conductor 502 may be of the same material and cross-sectional shape as conductor 310. Each conductor 502 may be electrically coupled to a bondpad (not shown), such as described above for bondpads 306 in FIGS. 3A and 3B. By eliminating the raised hedgerow 300, the illustrated conductor 502 is only slightly raised (by height 504) above the nozzle exit surface 304. Height 504, indicated by a pair of opposing arrows, is typically less than 5 μm.

The flattened hedgerow structure 500 has two layers deposited over substrate 220. The first primer layer 222 is optimized for edge short protection, and the second overlying layer 232 defines the fluidic channels, including feed channels 224, firing chambers 228, and nozzles 210. The flattened hedgerow structure 500 thus differs from the embodiment of FIG. 2B, where the primer layer 222 defines the feed channels and firing chambers. In the flattened hedgerow structure 500, the primer layer may have a thickness on the order of 2 μm, while the overlying layer 232 may have a thickness of up to 50 μm depending on the desired fluid droplet weight, as known to those of ordinary skill in the art.

One manner of constructing the printhead structure 500 begins by spin-coating a single first layer 222 of a photo-imagable polymer onto a wafer of substrate 220 at a desired thickness to form the edge short protection layer. A photo-mask may then be used to expose specific areas of the first layer to ultraviolet light, such as at the ends of the substrate 220. A second layer 232 may then be spin-coated on top of the first layer 222. Another photo-mask may then be used to expose specific areas of the second layer to ultraviolet light to form the fluidic regions, including the feed channels 224, firing chambers 228, and nozzles 210. After this second ultraviolet exposure, the uncured polymer then may be dissolved away, leaving only the exposed regions in the fluidic areas and at the ends of the nozzle arrays. Those of ordinary skill in the art may substitute other ways to create the two polymer layer structure 500.

Use of a thin first layer for edge short protection dramatically reduces the height of lead wires 502, which in turn allows for a closer nozzle-to-target spacing 506 than spacing 322 of FIG. 3B, yielding improved droplet placement, and improved image quality when dispensing ink. Furthermore, while the illustrated printhead structure 500 has the fluidic channels formed in the upper layer 232, the flattened hedgerow embodiment may be adapted to the printhead structure of FIG. 2B, by merely omitting the outermost portion of hedgerow 300 over which conductors 310 must traverse.

Figure 6:
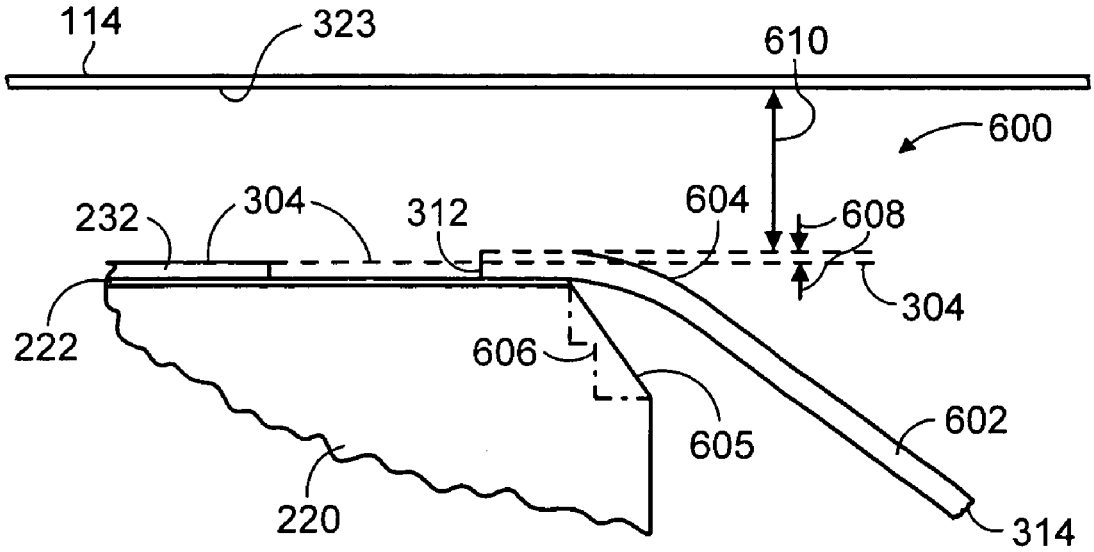
FIG. 6 is an enlarged, side elevational view of a portion of another embodiment of a fluid ejection device having a low profile conductor, suitable for use in the device of FIG. 2A.

FIG. 6 shows a sixth alternate embodiment of a fluid ejection device with low-profile conductors formed as a non-rectangular edge embodiment, such as a beveled edge printhead structure 600, which may be used as a modification to the flattened hedgerow structure 500 of FIG. 5. The beveled edge structure 600 may be substituted for the printhead structure shown in FIGS. 3A, 3B, 4E and used in inkjet cartridge 200 or other fluid ejection device designs. Flexible lead conductors, such as conductor 602 may be electrically coupled to an associated bondpad 306 as described with respect to FIGS. 3A and 5. Conductor 602 may be round wire conductors of the same size and material as described above for the conductors 310, or other shapes of conductors.

The flexible lead conductors 602 have a gentle bend 604 facilitated by a substrate 220 defining a non-rectangular edge, shown as a beveled edge 605, instead of the rectangular die edge 458 (FIG. 4) or rectangular clean cut edge 330. A comparison of the bending of conductor 502 with that of conductor 602, shows that bend 604 has a greater arc, yielding a gentler bend radius than that of conductor 502. Alternatively, instead of the beveled edge 605, a stepped or notched edge 606 may be defined by substrate 220, with one example being shown in dashed-dotted lines, to allow conductors 602 to have the gentle bend 604. Other non-rectangular geometric configurations, such as arcs, or a combination of arcs, steps, angles, etc., may be used on substrate 220 to reduce the corner where the flex leads bend away toward surface 206, 206' from their attachments at bondpads 306. This edge structure 605, 606 may be formed in a variety of different ways known to those of ordinary skill in the art, such as by molding, etching or tooling, for example.

In constructing the printhead layers 222 and 232 in one of the various ways described above with respect to FIG. 5, the top of conductor 602 may be of a dimension 608 above the nozzle exit surface 304, as indicated by the pair of opposing arrows in FIG. 6. Thus, if the construction of layers 222 and 232 is as described above for the flattened hedgerow structure 500, dimension 608 may represent a loop height of under 5 μm, which is a substantial improvement from the loop height 325 of over 30 μm above the nozzle exit surface 304 in the embodiment of FIGS. 3A and 3B. A lower loop height results in a closer nozzle-to-target spacing 610 than spacing 322 of FIG. 3B, which yields more accurate drop placement, resulting in higher print image quality when ejecting ink in printing system 100, while avoiding edge shorts due to the non-rectangular edge 605.

Figure 7:
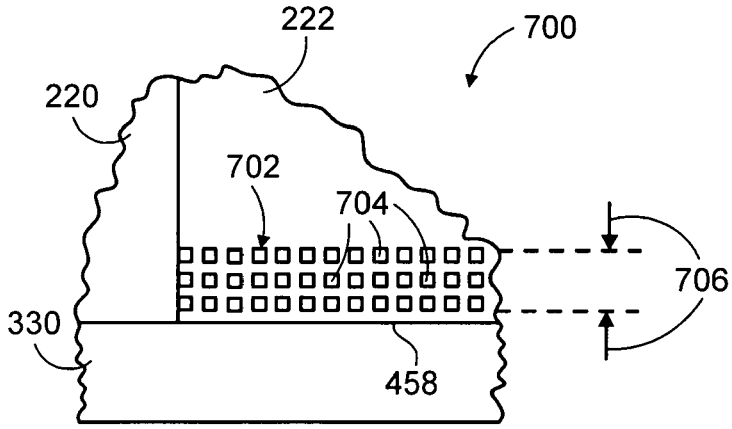
FIG. 7 is top plan view (relative to the view of FIG. 2A) of another embodiment of a portion of a fluid ejection device having a low profile conductor by avoiding chipping which may otherwise lead to electrical shorts, suitable for use in the device of FIG. 2A.

FIG. 7 shows a further embodiment of a fluid ejection device with low-profile conductors having a perforated primer layer printhead structure 700. The structure 700 may be used as a modification to the flattened hedgerow structure 500, or the non-rectangular edge structure 600. A clean cut edge 330 of structure 700 helps ensure that the primer layer 222 extends to the die edge 458 to prevent die edge shorts. However, when forming the clean cut edge 330, cutting through the thin primer layer 222 in the region of the flattened hedgerow can sometimes inadvertently cause hedgerow chips in the primer layer to occur. Such chips can result in the type of die edge shorts that the clean cut edge 300 is intended to prevent.

To control the extent of hedgerow chipping, the perforated primer layer structure 700 is used with the primer layer 222. The perforated primer layer structure 700 has a perforation pattern 702 having an arrangement of multiple perforations 704. The perforations 704 may extend throughout the hedgerow region, or may extend a distance 706, as indicated by a pair of opposing arrows, from the clean cut edge 330. The perforated primer layer structure 700 advantageously constrains the hedgerow chipping. For instance, in one embodiment having a 2 μm thick primer layer with square perforations as small as 2 μm on a side, a distance 706 of about 15 μm constrains the hedgerow chipping to only two to four micrometers (2–4 μm) from the clean cut edge 330. That is, hedgerow chips or cracks typically only breached the first few rows of perforations 704, and did not progress further than distance 706.

The relatively small size (e.g. 2 μm) of the perforations 704 compared to the diameter of flex leads 502, 602 (e.g. 30–32 μm) ensures that the primer layer material remaining between the perforations, even when cracked, provides adequate insulation between the flex leads and the underlying substrate 220 so as to prevent edge shorts. The perforations 704 may be formed during the photo-etching process, or in any other manner known to those skilled in the art.

While FIG. 7 shows rectangular perforations 704, other shapes of perforations are also contemplated and may be more suitable in other embodiments, such as round holes, slots, other polygonal shapes, or various combinations thereof. Moreover, while perforations 704 are illustrated as arranged in a grid-like pattern 702, other patterns may be used, including random patterns. Using a pattern of perforations in the thin layer overlying a substrate near a saw cut edge provides a method of constraining edge cracking of the thin layer to the perforation pattern without encroaching upon an unperforated portion beyond the perforation pattern.

FIGS. 8A–8D show another embodiment of a fluid ejection device with low-profile conductors and a compartmentalized hedgerow printhead structure 800. Structure 800 may be used as a modification to the printhead structures of FIGS. 3A, 4E, 5 or 6, and may include the structure of FIG. 7. The compartmentalized hedgerow structure 800 may be used in ink-jet cartridge 200 or other fluid ejection device designs.

Figure 8A:
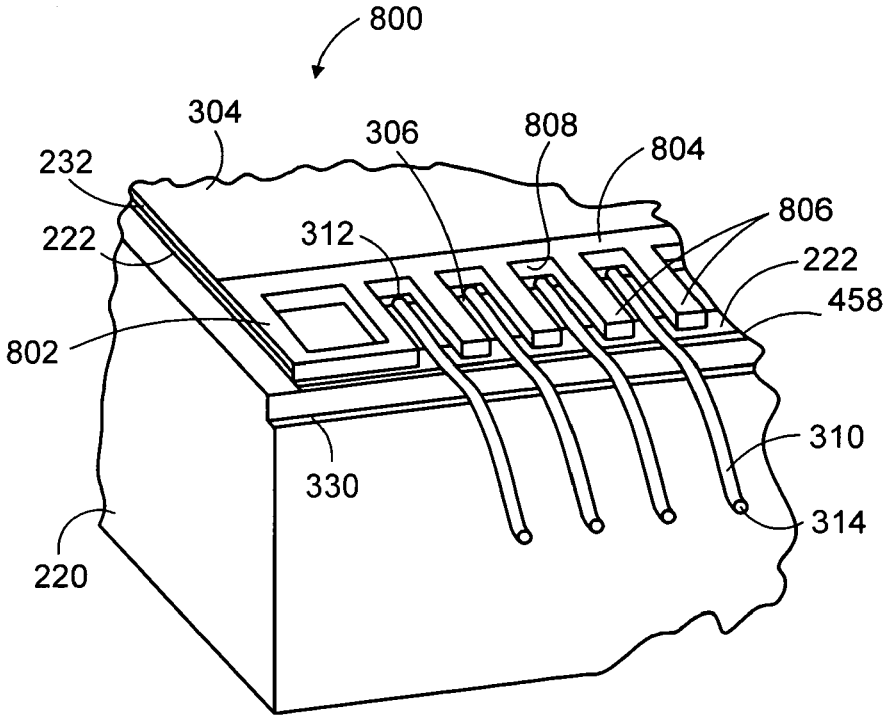
FIGS. 8A–8D are views of another embodiment of a portion of a fluid ejection device having a low profile conductor, suitable for use in the device of FIG. 2A.

FIG. 8A shows a compartmentalized hedgerow structure 800 having an open hedgerow 802 defined by layer 232. Hedgerow 802 has a rear wall 804 from which a series of sidewalls or fingers 806 project toward die edge 458'. The primer layer 222 extends under the open hedgerow 802, terminating at the die edge 458'. Primary layer 222 may incorporate a perforation pattern 702 as described above to prevent chipping of layer 222. Between each pair of adjacent fingers 806 and rear wall 804, the open hedgerow 802 defines an open compartment 808 which has one or more bondpads 306 housed therein each to receive a flex lead, such as a round wire flex lead 310. The term "open compartment" refers to a three-sided structure, with the flex leads 310 entering the compartment through an opening where a fourth wall would be situated if the compartment 808 were completely enclosed. The open compartments 808 and sidewalls or fingers 806 may be formed during the photo-etching process. Typically, the bondpads 306 do not extend all the way to the die edge 458', but rather are set back a distance from the edge 458'. Accordingly, the flex leads 310 will lay flush against the insulating feature 222 as they exit the open compartment 808 adjacent the die edge 458'.

Figure 8B:
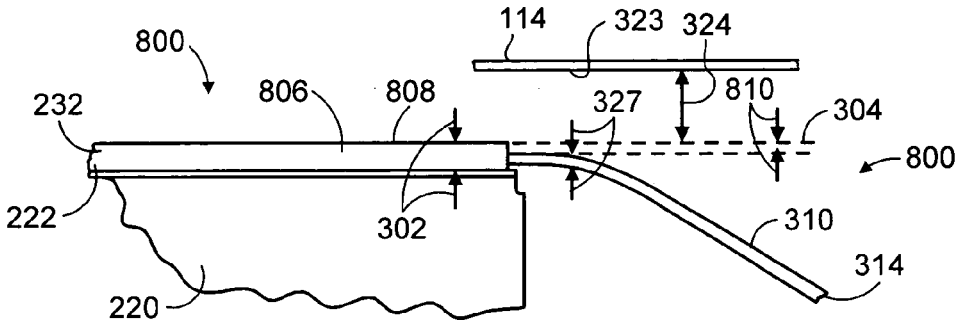

The embodiment illustrated in FIG. 8B shows the difference in height above the surface of substrate 220 between the flex lead 310 and the nozzle exit surface 304. The difference in height is distance 810, indicated by a pair of opposing arrows. In this embodiment, the flex lead 310 is located beneath the top of the nozzle exit layer 304. Edge short protection is provided by extending the primer layer 222 to the edge of the substrate 220.

Figure 8C:
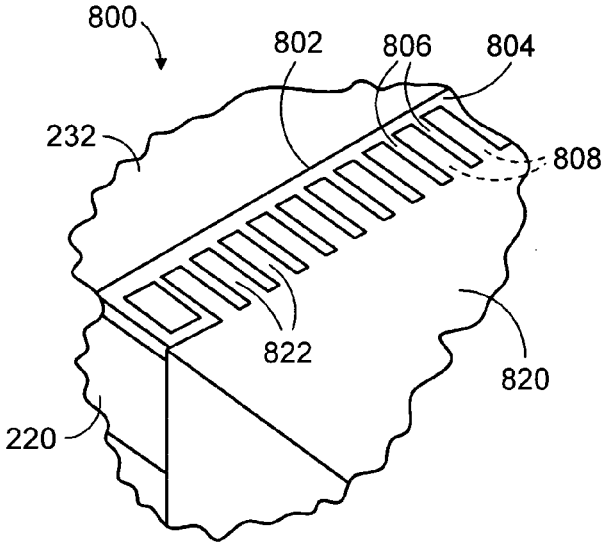
Figure 8D:
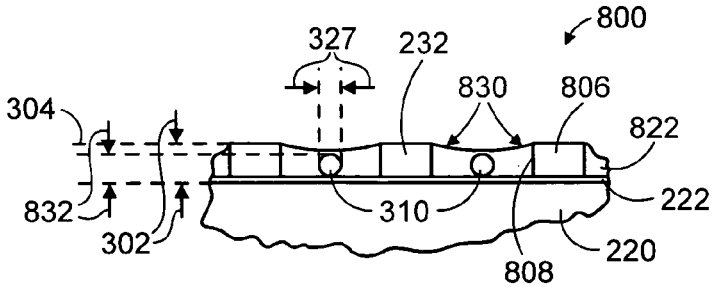

FIG. 8C shows an encapsulant layer 820 of a low viscosity, insulative, adhesive material, applied over the leads 310 and flowing into each compartment 808 as an encapsulant filling member 822. FIG. 8D shows a cross-sectional view of a couple of flex leads 310 and their associated encapsulant-filled compartments 808 is shown. In one embodiment, the low viscosity encapsulant layer 820 forms a meniscus in the filling members 822, as indicated by arrows 830. It should be noted that in an alternative embodiment, a high viscosity encapsulant material overcoats the top of leads 310, as shown in FIG. 3B for encapsulant bead 320. A high viscosity encapsulant can be used so the liquid encapsulant does not dribble or run-off of the top of the lead, exposing it to electrical shorts, ink contamination, and printhead wiping forces when installed in system 100.

In one embodiment, the compartmentalized hedgerow structure 800 uses a low viscosity encapsulant which wicks into the corners and crevices of compartments 808 and around flex leads 310 under capillary forces to displace any air pockets. A low viscosity encapsulant also produces a meniscus 830, creating a concave shape to an outer surface of encapsulant filling members 822 between bordering sidewalls or fingers 806. As mentioned above with respect to FIGS. 3A and 3B, the height of the hedgerow 300 above the substrate 220 is shown as distance 302, which is equal to the height above the substrate 220 of nozzle exit surface level 304. In comparison, the illustrated height of the encapsulant filling members 822 above the round wire conductors 310 is a lesser distance 832 above substrate 220, as indicated by a pair of opposing arrows in FIG. 8D. The encapsulated flex leads 310 in FIG. 8D lie beneath the nozzle exit surface 304.

This compartmentalized hedgerow structure 800 with flex leads 310 being located beneath the nozzle exit surface 304 protects the leads from being damaged if the paper 114 accidentally contacts printhead 110 during operation. Additionally, the flex leads 310 are also protected from damage due to a printhead wiping operation where, for example, an elastomeric wiper is typically used to remove ink and other residue from the surface of printhead 110. By creating a planar wiping service without encapsulant bead bumps such as 216 and 218 (FIG. 2A), the printhead 110 is more easily wiped and capped (hermetically sealed) during periods of printing inactivity.

Furthermore, the low viscosity encapsulant 820 also chemically protects leads 310 from any contamination by the ink. With the encapsulant filling members 822 extending beneath the nozzle exit surface 304, a nozzle-to-target spacing lower than spacing 322 may be achieved, leading to increased print quality when installed in system 100 due to a decrease in drop placement errors.

In conclusion, a variety of different embodiments for fluid ejection devices with low-profile conductors have been discussed. Namely, FIGS. 3A and 3B show a fully encompassing raised hedgerow 300, resulting in conductors 310 which arched a gap height 326 above the top of hedgerow 300 upon exiting. The next fluid ejection device discussed with respect to FIGS. 4A–4E uses weakened area flexible leads. Upon exiting the fully encompassing raised hedgerow 300, the exit wall serves as an insulating feature adjacent the die edge 458. Also, the weakened area leads 400, 420, 430 and 440 are laid flush across the exiting wall of hedgerow 300 due to the precise bending fostered by weakened areas at locations 452, 453 and 454.

Other embodiments change the structure of the hedgerow, the primer layer 222, and the substrate 220 to define an insulating feature, wherein the flexible leads are laid flush against primer layer 222 upon exiting the region where the bondpads 306 are arranged. These insulating features, with the flush exiting of the flexible leads, facilitate the use of economical round wire conductors 310, rather than the specially-formed weakened area leads of FIGS. 4A–4E. The flattened hedgerow embodiment of FIG. 5 eliminates the hedgerow altogether, so lead 502 rests directly on the primer layer 222 as the insulating feature. The non-rectangular edge embodiment of FIG. 6 improves on the design of FIG. 5 by removing material from substrate 220 at the corner edge where conductors 602 leave the insulating feature of the primer layer 222.

The embodiment of FIG. 7 addresses hedgerow cracks in the primer layer, which are caused by forming the clean cut edge 330. The primer layer 222 defines a series of perforations 702 along the clean cut edge 330 which control the cracking while still serving as the insulating feature under the exiting wires 310. The compartmentalized hedgerow embodiment of FIGS. 8A–8D recesses the flexible leads 310 beneath the nozzle exit surface 304, and then uses a low viscosity encapsulant to fill in the compartments around their associated conductor(s). The underlying primer layer 222 at the flexible lead exit to the compartments serves as the insulating feature.

While each of these embodiments have been discussed separately, in some cases some embodiments may be combined with each other. For instance, the perforated primer layer 222 of FIG. 7 may be combined with the compartmentalized hedgerow embodiment 800 of FIGS. 8A–8D. As another example, the weakened area flexible leads of FIGS. 4A–4E may be used instead of the round wire conductors 310 in the embodiments of FIGS. 5–8D.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

The invention claimed is:

1. A fluid ejection device for receiving a signal and ejecting fluid in response thereto, comprising:

an ink ejecting nozzle layer having a substrate with first and second surfaces joined along an edge;

an insulating feature located on the first surface adjacent the edge;

a flexible lead that bends around the edge and lies flush against the insulating feature; and a raised, encompassing hedgerow defining the insulating feature, the hedgerow having an exit wall, a rear wall, and two opposing sidewalls, the hedgerow surrounding a bondpad located adjacent to the insulating feature and coupled to a firing element.

2. The fluid ejection device of claim 1, further comprising a primer layer of an insulating material, which lies between the substrate and the nozzle layer to define the insulating feature.

3. The fluid ejection device of claim 2, wherein:

the primer layer defines a firing chamber around a firing element; and the firing chamber is configured in fluidic communication with the nozzle layer.

4. The fluid ejection device of claim 1, further comprising a primer layer of an insulating material having a substantially constant thickness, and lying between the substrate and the nozzle layer, with the primer layer defining the insulating feature of the substantially constant thickness.

5. The fluid ejection device of claim 1, wherein the edge has a cross-section of a non-rectangular shape.

6. The fluid ejection device of claim 5, wherein the non-rectangular shape comprises a beveled surface joining together the first and second surfaces.

7. The fluid ejection device of claim 5, wherein the non-rectangular shape comprises surface defining a notched out section joining together the first and second surfaces.

8. The fluid ejection device of claim 5, wherein the non-rectangular shape comprises a stepped surface joining together the first and second surfaces.

9. The fluid ejection device of claim 1, wherein the insulating feature comprises a primer layer of an insulating material having plural perforations therethrough adjacent the edge.

10. The fluid ejection device of claim 9, wherein the plural perforations each comprise a rectangular shape in a grid-like arrangement.

11. A fluid ejection device for receiving a signal and ejecting fluid in response thereto, comprising:

an ink ejecting nozzle layer having a substrate with first and second surfaces joined along an edge;

an insulating feature located on the first surface adjacent the edge; and a flexible lead that bends around the edge and lies flush against the insulating feature, wherein:

a portion of the flexible lead has a narrowed cross-section which defines a weakened area, the flexible lead bent at the weakened area such that another portion of the flexible lead lies flush against the insulating feature and the weakened area is located at a void in the flexible lead.

12. The fluid ejection device of claim 11, wherein the flexible lead has plural portions each defining a weakened area at which the flexible lead bends.

13. The fluid ejection device of claim 11, wherein the flexible lead has a rectangular cross-section with a pair of opposing first and second surfaces, the weakened area is formed by two opposing notched areas defined by the first and second surfaces and the first surface lies flush against the insulating feature.

14. The fluid ejection device of claim 11, wherein the flexible lead has a rectangular cross-section with a pair of opposing first and second surfaces, and a pair of opposing third and fourth surfaces, the weakened area is formed by two opposing notched areas defined by the third and fourth surfaces and the first surface lies flush against the insulating feature.

15. The fluid ejection device of claim 11, wherein the void extends partially through the flexible lead.

16. The fluid ejection device of claim 11, wherein the void extends completely through the flexible lead.

17. The fluid ejection device of claim 11, further comprising plural voids in the flexible lead at the weakened area.

18. A fluid ejection device for receiving a signal and ejecting fluid in response thereto, comprising:

an ink ejecting nozzle layer having a substrate with first and second surfaces joined along an edge;

an insulating feature located on the first surface adjacent the edge;

a flexible lead that bends around the edge and lies flush against the insulating feature;

a wall structure defining an open compartment that partially encloses a bondpad disposed on the substrate adjacent to the insulating feature; and an encapsulant disposed in the open compartment so as to encapsulate the flexible lead therein.

19. The fluid ejection device of claim 18, wherein the encapsulant has a viscosity when in a liquid form that allows wicking of the liquid encapsulant under capillary forces into corners of the open compartment and into regions between the flexible lead, bond pad, and the insulating feature.

20. The fluid ejection device of claim 18, wherein the encapsulant has an exposed surface covering the open compartment, with the exposed surface defining a meniscus between the wall structure.

21. The fluid ejection device of claim 18, wherein the flexible lead has a diameter of a first dimension and the wall structure projects from the insulating feature by a second dimension greater than the first dimension.

22. The fluid ejection device of claim 18, wherein the nozzle layer defines a nozzle exit surface laying in a nozzle exit plane and the wall structure projects from the insulating feature and terminates substantially within the nozzle exit plane.

23. A fluid ejection device, comprising:

means for defining a nozzle;

means for supporting the means for defining;

means for ejecting fluid from the nozzle in response to a firing signal;

means for receiving the firing signal; and means for insulating the means for receiving from the means for supporting, wherein the means for receiving lies flush against the means for insulating, wherein the means for supporting comprises a clean cut edge along which the means for insulating is located and the fluid ejection device further comprises means for controlling cracking of the means for insulating adjacent the clean cut edge.

24. The fluid ejection device of claim 23, wherein the means for supporting comprises first and second surfaces joined along an edge, the means for insulating is located on the first surface along the edge and the means for receiving bends around the edge.

25. The fluid ejection device of claim 23, wherein the means for insulating projects above the first surface.

26. The fluid ejection device of claim 23, wherein the means for defining defines a firing chamber within which the means for ejecting is located, with the firing chamber being in fluidic communication with the nozzle.

27. The fluid ejection device of claim 23, wherein the means for insulating also insulates the means for defining from the means for supporting.

28. The fluid ejection device of claim 23, wherein the means for receiving further comprises means for bending the means for receiving at a selected location.

29. The fluid ejection device of claim 23, wherein the means for controlling cracking comprises the means for insulating defining plural perforations therethrough.

30. The fluid ejection device of claim 29, wherein the means for defining also defines a nozzle exit surface located substantially in a nozzle exit plane, the means for surrounding projects from the means for supporting and terminates substantially in the nozzle exit plane and the means for receiving projects from the means for insulating and terminates before intersecting the nozzle exit plane.

31. The fluid ejection device of claim 23, further comprising means for surrounding the means for receiving and means for encapsulating the means for receiving within the means for surrounding.

32. A method of insulating a flexible lead from a substrate in a fluid ejection device which ejects fluid from a nozzle in response to a signal received through the flexible lead, the method comprising:

providing the substrate having first and second surfaces joined along an edge;

coupling the flexible lead to a firing element associated with the nozzle and responsive to the firing signal;

insulating the flexible lead from the substrate via an insulating feature supported by the first surface adjacent to the edge; and routing the flexible lead flush against the insulating feature, wherein the providing further comprises forming a clean cut edge adjacent the insulating feature, and controlling cracking of the insulating feature adjacent the clean cut edge.

33. The method of claim 32, further comprising bending the flexible lead around the edge to run substantially in parallel with the second surface.

34. The method of claim 32, further comprising weakening an area of the flexible lead and bending the flexible lead at the weakened area.

35. The method of claim 32, wherein the providing further comprises providing the substrate wherein the first and second surfaces are not substantially orthogonal.

36. The method of claim 32, further comprising surrounding the flexible lead with an open wall structure bounded by the insulating feature, and encapsulating the flexible lead within the open wall structure.

* * * * *